United States Patent [19]

Morrill

[11] 4,066,931

[45] Jan. 3, 1978

[54] SHUNT MODULATOR FOR HIGH CURRENT ARC LAMP

[75] Inventor: Daniel F. Morrill, Long Beach, Calif.

[73] Assignee: Ford Aerospace & Communications Corporation, Dearborn, Mich.

[21] Appl. No.: 556,005

[22] Filed: June 8, 1966

[51] Int. Cl.[2] ..... H05B 37/02; H05B 41/34

[52] U.S. Cl. ..... 315/241 R; 332/8; 315/240

[58] Field of Search ..... 332/8; 250/199; 315/92, 315/93, 125, 240, 241, 242; 307/100, 157

[56] References Cited

U.S. PATENT DOCUMENTS 3,387,177 6/1968 Israel et al. ..... 315/242

*Primary Examiner*—Nelson Moskowitz

*Attorney, Agent, or Firm*—Robert D. Sanborn

[57] ABSTRACT

Shunt modulator for high current arc lamp using series-connected voltage source, first transistor switch, inductor, and lamp. Whenever second transistor modulating switch in shunt with lamp is turned off, voltage surge from inductor fires lamp and first switch is turned on. When inductor current exceeds threshold, first switch is turned off and flyback diode provides return path for inductor current.

10 Claims, 1 Drawing Figure

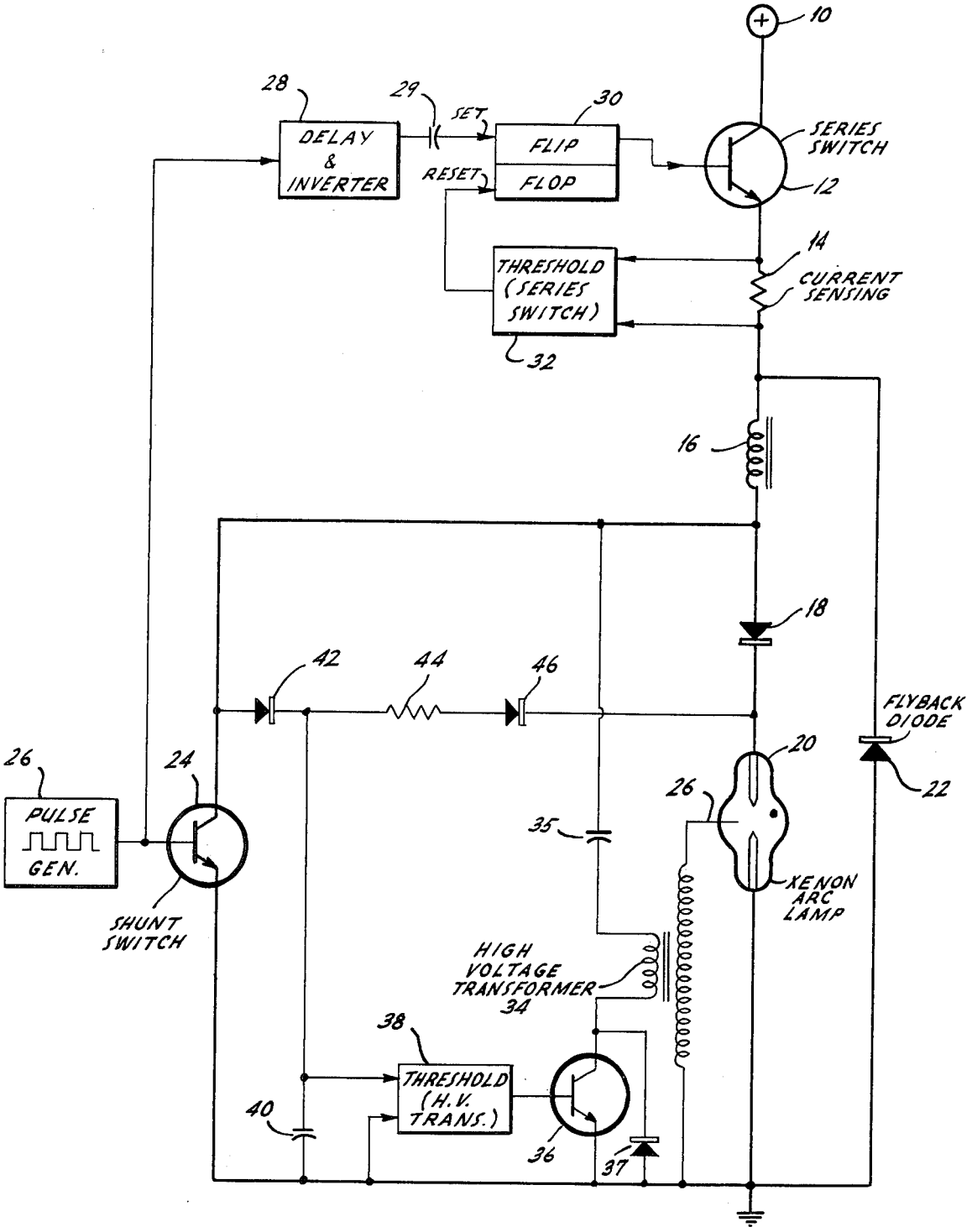
INVENTOR.
DANIEL F. MORRILL
BY
D P Bressman
ATTORNEY

SHUNT MODULATOR FOR HIGH CURRENT ARC LAMP

This invention relates to a circuit for repetitively supplying current to a load impedance, and more particularly to such a circuit wherein the load impedance is a high current gas arc lamp.

High current pressurized gas arc lamps may be used advantageously as a means of secret signaling inasmuch as a large portion of their output radiant energy spectrum is in the invisible infrared region. However it is not a simple matter to rapidly turn on and off such lamps because of their very high current and low voltage requirements, and because a "keep alive" current must be maintained in the lamp during its "off" intervals. Also, such lamps must have separate high voltage and boost voltage starting circuits to provide sufficient ionization to operate the lamp in a high current mode.

In a typical previous arc lamp modulator, described by Buckley in "Xenon Arc Lamps for Modulation" at pp 365–370 of the May 1963 issue of Illuminating Engineering, an arc lamp modulator is shown which comprises a paralleled group of power transistors in series with a voltage source and the arc lamp. The main disadvantages of this type of modulator are (1) the requirement of a power source whose voltage must be constant and substantially greater than the lamp running voltage and (2) low operating efficiency. The voltage of the power source must be relatively high in order to provide a sufficient voltage to insure that the lamp will fire during modulation thereof and to provide an added voltage range to enable the modulator to regulate current therethrough. The voltage of the power source must be kept substantially constant since this type of modulator will not operate properly if the voltage varies beyond a small range. These disadvantages are keenly felt in the design of a modulator for use with military type equipment. Since the running voltage of a typical high pressure gas arc lamp is 16–18 volts, an ordinary 24 volt military type source cannot be used to run such lamps since the voltage of such a source often varies throughout a wide range and occasionally may be as low as 14 volts, which is lower than the lamp running voltage. Accordingly, provision for a separate constant voltage source or a very expensive high current dc to dc converter must be provided. As will be apparent, all of these factors severely degrade the operating efficiency of the modulator.

Another disadvantage of the prior art type modulator is that separately-operated circuits must be provided to produce the high voltage and boost voltage needed to start the lamp. It would be desirable if the starting circuits could be made automatic so as to operate in conjunction with the regular lamp modulator.

The present invention provides an arc lamp modulator which overcomes the drawbacks of prior art modulators aforenoted. Accordingly, several objects of the invention are (1) to provide a gas tube arc lamp modulator which draws reduced power from a voltage source, (2) to provide such a modulator which can operate from a lower voltage power source, whose voltage can even be lower than the lamp running voltage, (3) to provide such a modulator which will operate from a power source whose voltage may vary throughout a wide range, and (4) to provide such a modulator which can be started automatically and does not require any separate starting circuit. Other objects and advantages of the present invention will become apparent in conjunction with the following description thereof.

SUMMARY

The arc lamp modulator circuit of the present invention comprises a voltage source, a series switch, an inductor, and an arc lamp connected in series. A shunt switch which may be alternately rendered conductive and nonconductive is connected across the lamp and means are provided for rendering the series switch conductive when the shunt switch is rendered nonconductive and for rendering the series switch nonconductive when the current in the inductor exceeds a predetermined value. Also a flyback diode is provided to provide a return path for the current in the inductor when the series switch is rendered nonconductive.

A schematic diagram of a system according to the invention is shown in the single FIGURE of drawing.

DESCRIPTION OF CIRCUIT

The description of the circuit of the invention may be divided conveniently into three sections: the high current circuit, the control circuit, and the high voltage starting and keep alive circuit.

The high current circuit comprises the voltage source 10, a series switching transistor 12, a current sensing resistor 14, an inductor 16, a diode 18, the arc lamp 20, a flyback diode 22, and a shunt switching transistor 24. Except for diode 22 and transistor 24, these elements are all connected in series. The flyback diode 22 is connected across the grounded terminal of the arc lamp and one terminal of the inductor. The shunt switching transistor 24 is connected from the other terminal of the inductor to ground. The grounded terminal of the arc lamp represents one terminal of voltage source 10.

Arc lamp 20 is filled with pressurized xenon gas (e.g., at 5 atmospheres) and has two high current electrodes and a starting electrode 26. In lieu of lamp 20, any desired high current load impedance may be used since the invention is suitable for repetitively switching current to practically any low impedance load.

The series and shunt switching transistors 12 and 24 as well as diodes 18 and 22 must of course be capable of handling the heavy currents drawn by the arc lamp 20. For example, the arc lamp may operate with 20 amperes of current. Additional transistors can be paralleled with each of transistors 12 and 24 to handle this current, if required. Current sensing resistor 14 has a very low impedance on the order of several milliohms or sufficient to provide a current-indicating output voltage which can be sensed by control circuitry. The voltage of source 10 may vary through wide limits without adversely effecting the operation of the circuit. The voltage may range from approximately one half the value of the running voltage (on the order of 15–20 volts) of lamp 20 to over double said running voltage.

The control circuit comprises a pulse generator 26, a delay and inverting unit 28, a flip flop 30 and a threshold circuit 32. Generator 26 may represent any suitable source which will provide positive pulses at the rate at which the lamp 20 is to be switched. Generator 26 should, of course, be able to provide sufficient current to drive shunt transistor 24 on and off. The output of generator 26 is connected to base of the shunt transistor 24 and also to the input of delay and inverting unit 28.

The delay and inverting unit 28 is arranged to supply an output which represents an inverted and optionally, slightly delayed, version of the output signal from generator 26. The output of unit 28 may be delayed slightly when it is desired to have the operation of the series switch 12 slightly mismatched to that of shunt switch 24 in order to reduce adverse noise effects. The delay, if used, should be a small fraction of the shortest pulse period supplied by generator 26.

The output of unit 28 is connected to the SET input of flip flop 30 by way of a coupling capacitor 29. Flip flop 30 operates so that when a pulse is supplied thereto by unit 28, its output, which is connected to the base of series transistor 12, will be energized with a positive voltage of a magnitude sufficient to render series transistor 12 conductive.

The RESET input of flip flop 30 is derived from the output of threshold circuit 32 whose inputs are connected across the current sensing resistor 14. When the current in resistor 14 exceeds a predetermined value, the voltage thereacross will be sufficient to trigger threshold circuit 32. Circuit 32, when triggered will provide an output pulse which resets flip flop 30, thereby to turn series switch 12 off.

The high voltage starting and keep alive circuit comprises a high voltage transformer 34 having primary and secondary windings. The secondary winding is connected from ground to the starting electrode 26 of lamp 20. The primary winding is connected, via coupling capacitor 35, to the collector of transistor 24 and to the collector of a transistor 36. The collector of transistor 36 is also connected to ground by a protective diode 37. The emitter of transistor 36 is connected to ground and the base thereof is connected to the output of a threshold circuit 38 which is arranged to turn transistor 36 on when the input voltage thereto exceeds a predetermined value. One input of the threshold circuit 38 is connected to ground and the other input thereof is connected to the upper terminal of a charging capacitor 40. The lower terminal of capacitor 40 is grounded. The uppr terminal of capacitor 40 is also connected to the collector of transistor 24 by way of diode 42 and to the upper high current electrode of lamp 20 by way of a current limiting resistor 44 and another diode 46.

OPERATION OF CIRCUIT

The starting and running modes of the circuit will be described separately. As long as pulses are supplied by generator 26, the lamp 20 will start automatically and begin operating in high current mode after a brief starting interval. If the pulses from source 26 are interrupted, lamp 20 will be extinguished but will restart automatically when pulses from generator 26 are supplied again.

STARTING MODE

When pulses are supplied by generator 26, they will be inverted and delayed briefly in unit 28, and will then set flip flop 30, which will hold series transistor 12 on. The pulses from generator 26 will also turn shunt transistor 24 alternately on and off. Each time shunt transistor 12 is turned on, current will be drawn from source 10, through series transistor 12, resistor 14, inductor 18, and shunt transistor 24 to ground. When shunt transistor 24 is turned off, this current will not be able to flow through transistor 24 but will be routed through diode 42 to charge capacitor 40. (At this time, no current will flow through the primary of high voltage transformer 34 inasmuch as transistor 36 will be nonconductive, and no current will flow through lamp 20 since it is not yet ionized.) When shunt transistor 24 is again made conductive, diode 42 will prevent capacitor 40 from discharging to ground through shunt transistor 24. As shunt switch 24 is turned on and off by the pulses from generator 26, an increasing voltage charge will be built up on capacitor 40 and the current in inductor 16 will increase.

The operation of arc lamp 20 is such that it cannot be fired until an initial high ionizing voltage on the order of 30KV is supplied to electrode 26 and a boost starting voltage about three times running voltage (e.g., 60 volts) is supplied across the main terminals thereof. The purpose of the initial high voltage on electrode 26 is to provide an initial ionization to break down the gas in the lamp. The purpose of the boost starting voltage is to provide a continuous electron avalanche across the lamp to raise the tip of the lower of the high current electrodes to a suitable operating temperature and to create a sufficient plasma within the envelope to conduct the high lamp operating current. After a sufficent plasma is created, the lamp will operate in a high current mode with a regular running voltage thereacross and high light output. During the "off" intervals in lamp operation, the regular running voltage is not applied to the lamp, but a keep alive current of about one tenth the regular lamp operating current must be provided in the lamp in order to maintain a plasma therein so that the lamp will start at the next "on" interval thereof then the lamp is modulated at low frequencies. The keep alive current also improves the stability of the arc when the lamp is modulated at higher frequencies.

When the voltage on capacitor 40 has built up to the predetermined value of the boost voltage required by lamp 20, the preset threshold circuit 38 will turn transistor 36 on, thereby allowing the voltage variations at the collector of electrode transistor 24 to be applied across the primary winding of transformer 34. The resultant current variation in the primary winding will cause a very high voltage (e.g. 30KV) to be supplied across the secondary winding of the transformer at hence to the starting electrode 26. Since the boost voltage across capacitor 40 is also continuously supplied to the upper terminal of lamp 20 by way of resistor 44 and diode 46, a current will travel across the main electrodes of the lamp when the high voltage supplied to electrode 26 ionizes the gas within the lamp. Diodes 46 and 18 isolate transistors 24 and 12 from the high voltage supplied to the lamp at electrode 26.

REGULAR RUNNING MODE

As soon as the boost voltage from capacitor 40 creates a continuous electron avalanche between the main terminals of lamp 20, current will be supplied through lamp 20 from source 10 by way of source switch 12, resistor 14, inductor 16, and diode 18. The next pulse from generator 26 will turn shunt transistor 26 on and provide a substantially zero impedance in shunt with lamp 20. Current will be diverted from lamp 20 to transistor 24 and this current will increase due to the zero impedance load of transistor 24. When the current increases to a preset level, a sufficient voltage will appear across resistor 14 to trigger threshold circuit 32. Circuit 32 will provide an output to reset flip flop 30 and thereby turn series transistor 12 off. The current in inductor 16 will not terminate due to the energy stored therein. A return path for the inductor's current will be provided by shunt transistor 24 and flyback diode 22.

During this interval a small alive current will be provided through lamp 20 by the charge stored on capacitor 40. Said charge will be limited by resistor 44 to a level sufficient to maintain the continuous electron avalanche in tube 20, but insufficient to provide any substantial radiant energy output from lamp 20.

After the pulse from generator 26 terminates, shunt transistor 24 will be non-conductive and, after a brief delay due to unit 28, series transistor 12 will be turned on. Current will now be supplied to lamp 20 from source 10 by way of series switch 12 and inductor 16. The voltage from source 10 will reverse bias flyback diode 22. Lamp 20 will now provide a high level radiant energy output until the next pulse from generator 26 turns shunt transistor 24 on. Thereafter the pulses from generator 26 will cause the above described cycle events to be repeated.

The combination of series transistor 12 and inductor 16 may be considered as a substantially constant current source which is self-regulated by the operation of the circuit. Current will always flow in inductor 16 during both the "on" and "off" intervals of lamp operation, and current in lamp 20 is controlled by current routing rather than by current starting and stopping. Even if the voltage provided by source 10 is lower than the running voltage of lamp 20, the circuit will still operate satisfactory because inductor 16 will provide an inductive voltage surge each time shunt switch 24 is turned off. This higher voltage inductive surge will last throughout each running period of lamp 20. Due to the current regulating feature of the circuit, the circuit will operate satisfactorily despite wide variations in the voltage of source 10.

Secret signalling may be accomplished with the circuit of the invention by modulating the pulses from generator 26 with information in any desired manner. For example, pulse width modulation, pulse position modulation, pulse frequency modulation, etc. may be used. The modulator will operate at rates at least as high as 10 KHz.

While there has been described what is at present considered to be the preferred embodiment of the invention it will be apparent that various modifications and other embodiments thereof will occur to those skilled in the art within the scope of the invention. Accordingly, it is desired that the scope of the invention be limited by the appended claims only.

I claim:

1. In combination:

a. a circuit comprising the following elements connected in series: a potential source, a series switch, an inductor, and a load impedance, b. a shunt switch connected across said load impedance, c. means for rendering said shunt switch alternately conductive and nonconductive, d. means for rendering said series switch conductive when said shunt switch is rendered nonconductive, and e. means for rendering said series switch nonconductive when the current in said inductor exceeds a predetermined value.

2. The combination of claim 1 further including means for providing a return path for current in said inductor when said series switch is rendered nonconductive.

3. The combination of claim 2 wherein said means for providing a return path comprises a diode connected across the combination of said inductor and said load impedance.

4. The combination of claim 1 wherein said series switch and said shunt switch each comprise the collector-emitter circuit of a transistor.

5. The combination of claim 1 wherein said (e) means comprises means for providing a voltage proportional to the current in said inductor, means for providing a predetermined output signal when said proportional voltage is greater than a predetermined level, and means for rendering said series switch nonconductive in response to said predetermined output signal.

6. The combination of claim 1 wherein said load impedance is a gas arc lamp which comprises a closed envelope containing a pressurized ionizable gas and a pair of electrodes in contact with said gas.

7. A gas tube modulator, comprising:

a. a gas tube comprising an enclosed envelope filled with an ionizable gas and containing two electrodes in contact with said gas, b. an inductor and means connecting one of said electrodes to one terminal of said inductor, c. a voltage source and means connecting the other of said electrodes to one terminal of said source, d. first switch means arranged to connect the other terminal of said inductor to the other terminal of said source only in response to a first predetermined input, e. second switch means arranged to connect together said two electrodes of said gas tube only in response to a second predetermined input, f. means for intermittently supplying said second predetermined input to said second switch means, g. means for supplying said first predetermined input to said first switch means upon each termination of said second predetermined input to said second switch means, and h. means for terminating said first predetermined input to said first switch means when the current in said inductor exceeds a predetermined value.

8. The modulator of claim 7 further including a flyback diode connected between said one terminal of said source and the other terminal of said inductor.

9. The modulator of claim 7 wherein said (g) means comprises: (a) a flip-flop arranged to supply aid first predetermined output to said first switch means when said flip-flop is in one of its stable states, and (b) means for setting said flip-flop in said one stable state upon each termination of said second predetermined input to said second switch means; and wherein said (h) means comprises means for resetting said flip-flop in the other of its table states when the current in said inductor exceeds a predetermined value.

10. The modulator of claim 9 wherein said first and second switch means each comprises a transistor.

* * * * *